United States Patent [19]

Rogers et al.

[11] Patent Number: 4,882,803

[45] Date of Patent: Nov. 28, 1989

[54] DENTAL APPARATUS

[76] Inventors: Nathan J. Rogers; Barbara R. Rogers, both of 695 Goodhue, Beaumont, Tex. 77706

[21] Appl. No.: 286,257

[22] Filed: Dec. 19, 1988

[51] Int. Cl.[4] ..... A46B 9/04

[52] U.S. Cl. ..... 15/167.1; 15/143 R; 15/DIG. 5; 15/110

[58] Field of Search ..... 15/167.1, 110, 143, 15/DIG. 5

[56] References Cited

U.S. PATENT DOCUMENTS

| | | | |
|---|---|---|---|
| 3,010,131 | 11/1961 | Kisky | 15/167.1 |
| 3,177,509 | 4/1965 | Cyzer | 15/167.1 X |
| 4,031,587 | 6/1977 | Dietricn | 15/167.1 |
| 4,033,008 | 7/1977 | Warren et al. | 15/167.1 |
| 4,403,623 | 9/1983 | Mark | 15/167.1 |
| 4,432,114 | 2/1984 | Goudsmit | 15/167.1 X |
| 4,502,177 | 3/1985 | Beggs | 15/167.1 |
| 4,524,478 | 6/1985 | Ross | 15/167.1 X |
| 4,672,706 | 6/1987 | Hill | 15/167.1 |
| 4,679,273 | 7/1981 | Okin | 15/167.1 |
| 4,712,266 | 12/1987 | Yamaki | 15/167.1 |

*Primary Examiner*—Frankie L. Stinson

*Attorney, Agent, or Firm*—Al Harrison; John Egbert

[57] ABSTRACT

A dental apparatus adapted for penetrating and cleaning the interstices and interproximal surfaces between the teeth, the surfaces at and below the gum margins, and the tooth-gum interfaces including the grooves and crevices thereof, is provided. In a preferred embodiment, a neck portion interconnects an elongated handle portion and a head portion, with the head portion being angled upwardly of the handle portion. A plurality of tufts of bristles are fixedly attached to the face of said head portion, said tufts of bristles having wedge means and conforming means to enable penetration into and cleaning of said interstices, surfaces and interfaces.

A single row of a plurality of tufts of bristles, disposed substantially perpendicularly of said handle portion, has the free end of each of said plurality of tufts which are disposed at said end of said head portion beveled, said bevel sloping upwards from a vertex formed at said free end of the outermost bristle in each of said tufts. The tufts of bristles also have a plurality of bristles of varying lengths such that a concave surface generally corresponding to the convex configuration of the surfaces of the teeth is formed by the said free ends thereof. The longer bristles have the firmness substantially the same as the bristles of conventional hard-bristled toothbrushes and the shorter bristles have the firmness substantially the same as the bristles of conventional medium-bristled toothbrushes.

In accordance with the concept of the present invention, the contours and configuration of the tufts of bristles in combination with the relative lengths and firmness thereof, afford a convenient and reliable apparatus and method to penetrate and clean the hard-to-reach surfaces and embrasures of the tooth-gum interfaces.

17 Claims, 2 Drawing Sheets

FIG. 1
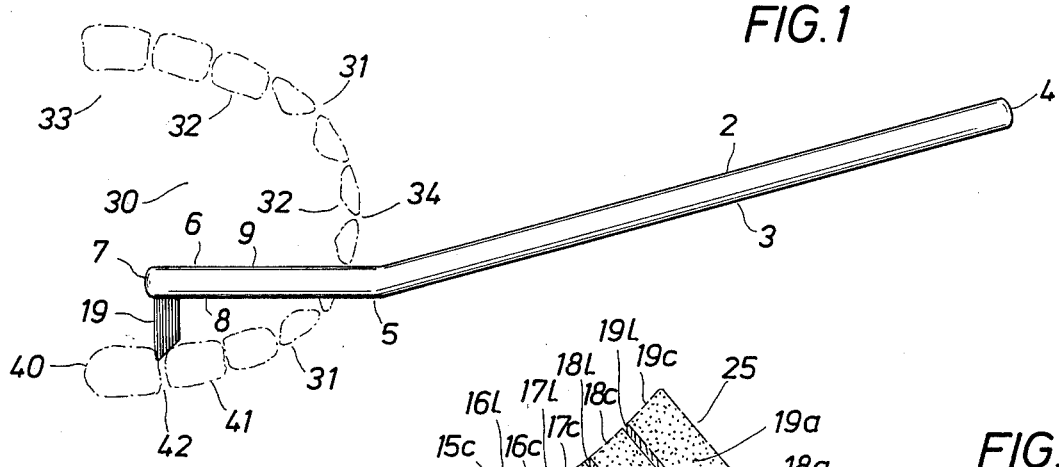
FIG. 2
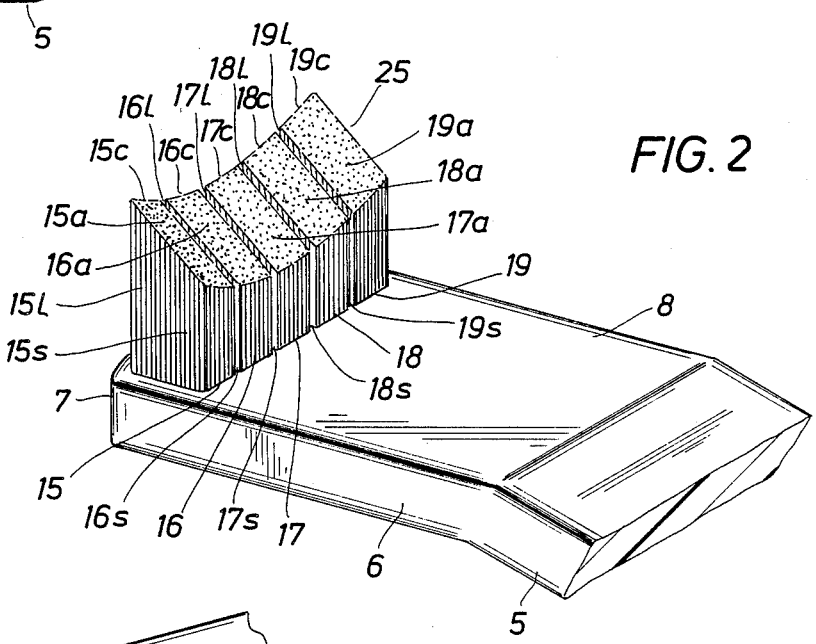
FIG. 3
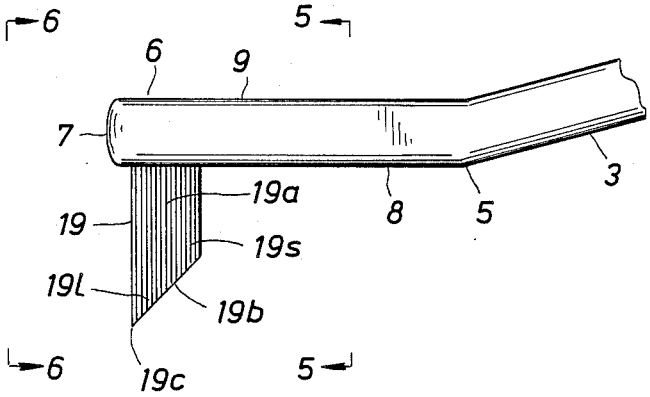
FIG. 5
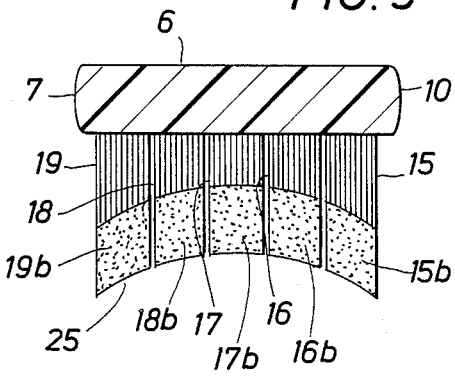
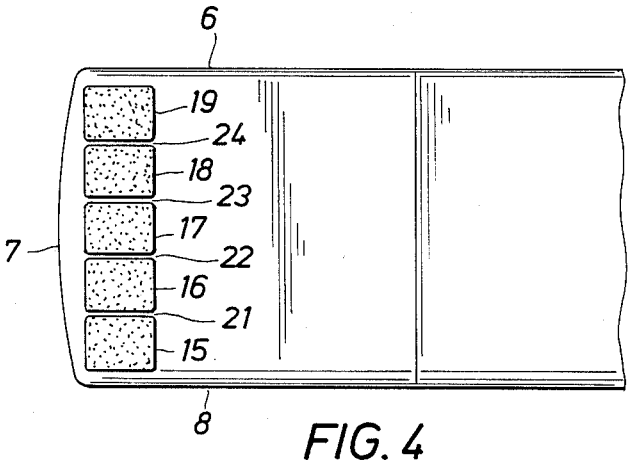
FIG. 4
FIG. 6
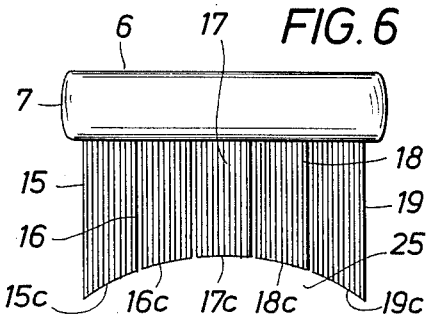

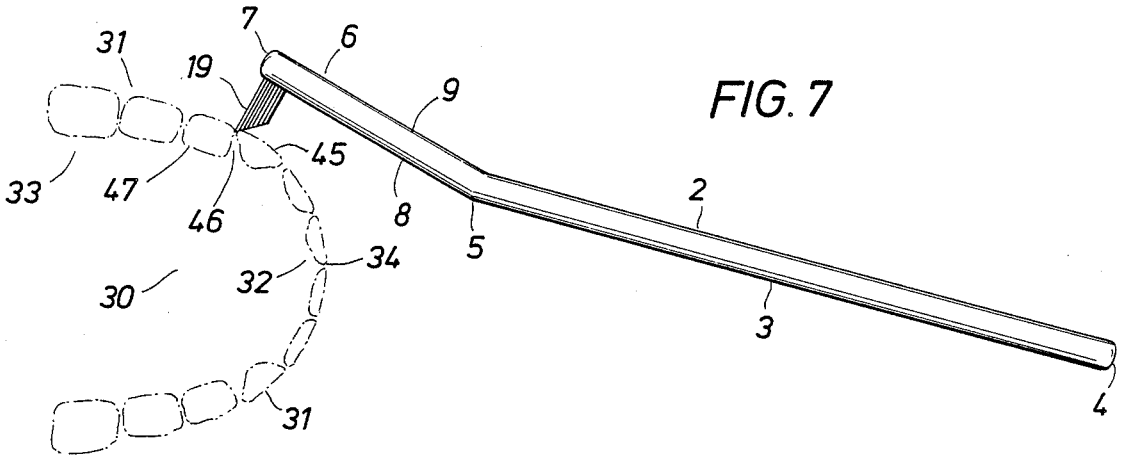
FIG. 7
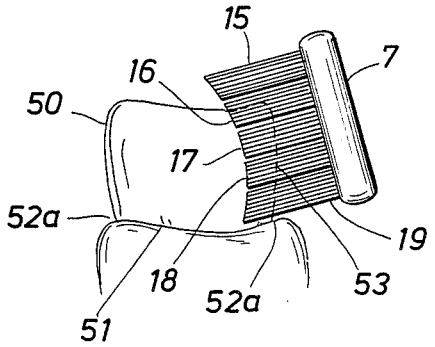
FIG. 9
FIG. 8
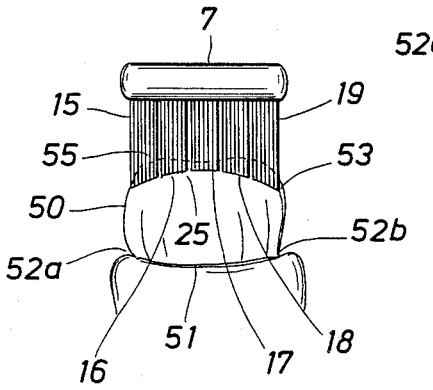
FIG. 10
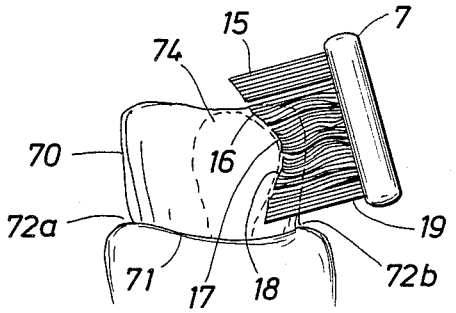
FIG. 11
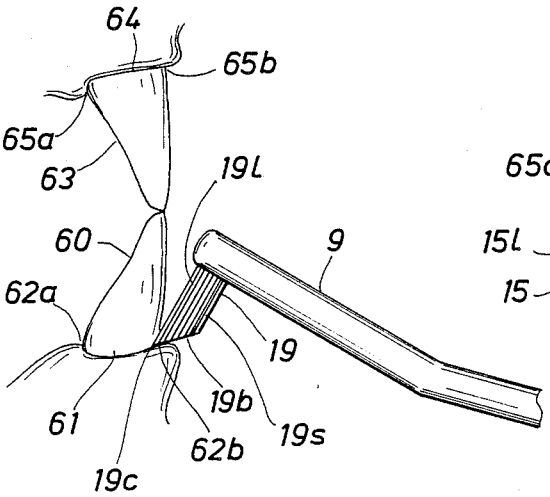
FIG. 12
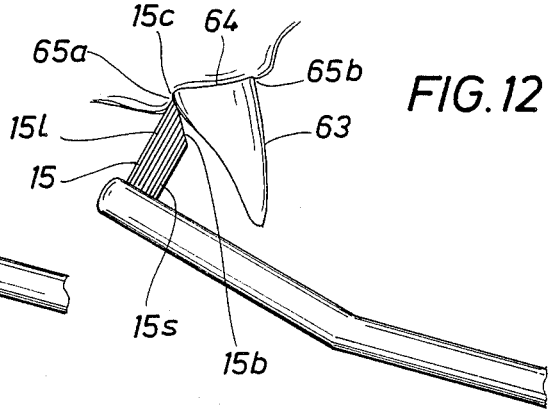

DENTAL APPARATUS

BACKGROUND OF THE INVENTION

This invention relates to the care and cleaning of human teeth, and more particularly relates to methods and apparatus for cleaning the interproximal surfaces of the teeth, the gum margins, grooves and embrasures thereof.

It is well known in the prior art that toothbrushes have been integrated into a daily regimen of effective personal dental hygiene. Indeed, toothbrushes are the primary implement regularly used to prevent the formation of plaque on the surfaces of the teeth.

It is also well known that plaque, a sticky film consisting of food particles, saliva and bacteria formed on the surfaces of the teeth, if not removed from these surfaces by abrasive action and the like, ultimately forms hardened deposits of tartar. Of course, as is known to those skilled in the art, once tartar is formed, it may be removed only by a dentist. If, on the other hand, tartar is not removed therefrom, dental decay and even periodontal disease are apt to occur.

Accordingly, to avoid dental decay and disease, daily brushing and flossing of the teeth and gums is recommended by dentists and the like. The use of conventional toothbrushes and dental floss tends to clean the easy-to-reach or free surfaces of the teeth, the gum margin in the front and labial portion of the mouth cavity, and the embrasures between the teeth, particularly where there is no or minimal impacting between adjacent teeth. On the other hand, convenient cleaning of difficult-to-reach embrasures between the teeth, particularly where there is impacting between adjacent teeth, the gum margin in the rear and lingual portion of the mouth cavity, and the grooves and crevices of the gums, is still lacking an adequate solution in the prior art.

Many effective toothbrush designs are known in the art for the cleaning of the free surfaces of the teeth. The toothbrush art, however, has only been marginally successful in providing a convenient and effective means and method for reaching and cleaning the difficult to access surfaces and spaces of the teeth and gums.

For example, in U.S. Pat. No. 2,043,898, Malcolm discloses a toothbrush constructed with a series of bristles which form oval or elliptical ridges to avoid interference between neighboring bristle tufts while attempting to reach embrasures of the teeth. To promote the brush reaching into the groove formed at the gum margin, the outer tufts are wedge-shaped at the transverse portion of the ridge. While an objective of this bristle configuration is to enable the bristle tips to reach into the tooth-gum interface's grooves and spaces, and into embrasures between adjacent teeth, it should be apparent to those skilled in the art that the bulk of the head portion of the brush as well as the size and arrangement of the bristle tufts preclude substantial penetration of the bristles into these difficult-to-reach areas.

In U.S. Pat. No. 1,943,225, McIntyre disclosed a toothbrush with each tuft of bristles being provided with a crest and free ends cut to form oppositely inclined beveled edges. With these crests of tufts configured alternatively transversely and longitudinally of the head of the brush, the purpose is to penetrate the interproximal spaces of the teeth and to contact the surfaces thereof. Again, the bulky and longitudinal arrangement of the tufts of bristles along the head of the brush, inhibit penetration of the bristles into these difficult-to-reach areas, and the effective cleaning thereof.

As is also well known in the art, it is more difficult to access the interproximal spaces, grooves and embrasures, and the gum margin, in the interior, lingual portion of the mouth cavity than to access the corresponding areas in the exterior, labial portion thereof. Accordingly, it should be clear to those skilled in the art that to effectively reach and access said areas requires an apparatus consisting of structures which cooperate with the contours of the teeth and environing gums to provide penetration and cleaning thereof.

The surface of the toothbrush disclosed in U.S. Pat. No. 4,679,273 is designed to coincide with the contours of the gum margins. An important objective of this toothbrush is to overcome the limitation of the prior art whereby there is minimal contact between the tooth-gum interfaces because of erratic placement of the bristles upon the said interfaces. Thus, the concept therein is to construct a toothbrush with an undulating brushing surface of alternating convex and concave regions of tufts of bristles wherein said regions conform to the gum margins adjacent the teeth. Additionally, to facilitate the application of the toothbrush in a level, horizontal plane in the mouth cavity, the handle portion is preferably angled down from the head portion thereof.

To further promote the penetration of these bristles into the said tooth-gum interfaces, particularly in the rear portion of the mouth cavity, the brush head portion contains a single row of bristles. Unfortunately, this toothbrush affords limited maneuverability because of the longitudinal disposition of its tufts of bristles. Furthermore, the tendency of the bristles to spread radially, in conjunction with their rounded ends, minimizes penetration into the interproximal spaces of the teeth.

Similarly, the contoured toothbrush disclosed in U.S. Pat. No. 3,742,549 is designed to conform to the natural convexity of the teeth, thereby causing intimate contact between the toothbrush's bristles and the surfaces of the teeth. While the objective is to enable the said bristles to penetrate into the crevices of the gums and the embrasures between the teeth, the array of tufts of bristles is limited in its ability to penetrate these hard-to-reach and remote areas.

In an attempt to overcome limitations of the prior art, Stanford in U.S. Pat. No. 4,517,701 discloses toothbrushes intended for cleaning sulcular areas of the teeth at and below the gum margin thereof. Using a curved toothbrush head portion and soft bristles disposed on both sides thereon, this toothbrush affords improved contact with the gum margin and the tooth-gum interfaces. However, the shape and contour of the tufts of bristles still limit the penetration thereof into the hard-to-reach and remote areas of the mouth cavity.

Still other attempts to advance the toothbrush art are seen in U.S. Pat. Nos. 2,797,424 and 4,570,282. More particularly, Olson in U.S. Pat. No. 2,797,424, discloses a toothbrush with the conventional tuft array arrangement known in the prior art, but with outer rows of long, stiff and pointed bristles, and intermediate rows of shorter, soft and cup-shaped bristles. When placed adjacent the teeth, the outer bristles are guided into the interproximal spaces. Following the lead of the long outer bristles, the soft intermediate bristles spread out and contact the gum cuff and gum margin.

Kaufman in U.S. Pat. No. 4,570,282, discloses a toothbrush with bristles designed to maximize contact with the gum margins and surfaces. The novel v-shaped tooth receiving channel described therein tends to situate the bristles upon the gum surfaces, but affords limited penetration into the crevices and the grooves which characterize the tooth-gum interface.

Still another attempt to effectively remove plaque from difficult-to-reach tooth-gum interfaces is disclosed by d'Argembeau in U.S. Pat. No. 4,542,552. The toothbrush therein, unlike conventional toothbrushes, has bristles which are long enough to penetrate between the tooth-gum interface and reach the gum crevices and groove surfaces. Stiff bristles maintain the reaching ability of the elongated tufts which are disposed longitudinally of the toothbrush. It should be apparent to those skilled in the art that such brush design provides improved penetration features but is limited with regard to maneuverability of the bristles into the tooth-gum interfaces in the various portions of the mouth cavity. Furthermore, only minimal penetration of the bristles into constricted interdental spaces may be expected.

d'Argembeau in U.S. Pat. No. 4,573,920, also discloses a toothbrush with a thin bed of bristles disposed perpendicularly of the handle portion. The spacing of the bristles is designed to cooperate with the interdental width, whereby the bed can reach into the interproximal spaces and brush the surfaces therein.

As hereinbefore mentioned, the prior tooth-gum interface cleaning art is not necessarily confined to toothbrushes. Obviously, as a commonly used element of personal hygiene, a toothbrush is a familiar item and would tend to be accepted more than a new implement.

The toothpick and floss are also common dental implements which are widely used to clean the teeth and gums. Generally, the use of the toothpick is limited to dislodging food particles from between the teeth and the gum margins thereof. Toothpicks afford no facility for removing plaque from teeth. As is well known, an inherent hazard associated with toothpicks, particularly wooden toothpicks, is their tendency to splinter during use. Additionally, a toothpick's stiffness is ephemeral because of the deleterious affect thereon of the moistness of the mouth.

To extend the usefulness of toothpick-like implements, Yamaki in U.S. Pat. No. 4,712,266, discloses a whisk pick which is an apparatus which provides abrasive forces whereby plaque may be removed from the teeth. While broadening the cleaning characteristics of a toothpick, the whisk pick provides only limited access to and cleaning of the tooth-gum interfaces described herein.

Similarly, dental floss, is designed to dislodge food particles from between the teeth and the gum margins thereof. But floss is ineffective where adjacent teeth are impacted, whereby the floss is inhibited from passing therebetween. Furthermore, floss tends to tear where there is only a minimal interstice between adjacent teeth. Under these circumstances, the severed floss may be difficult to remove from the interstice, causing discomfort therewith. As is well known in the art, flossing is inherently slow and typically improperly administered. Accordingly, for these and other reasons, flossing is not universally integrated into a program of personal dental hygiene.

Accordingly, these limitations and disadvantages of the prior art are overcome with the present invention, and improved means and techniques are provided which are especially useful for penetrating and cleaning the interstices and interproximal areas between the teeth, the surfaces at and below the gum margins, and the tooth-gum interfaces including the grooves and crevices thereof.

SUMMARY OF INVENTION

The present invention provides a dental apparatus adapted for penetrating and cleaning the interstices and interproximal surfaces between the teeth, the surfaces at and below the gum margins, and the tooth-gum interfaces including the grooves and crevices thereof. In a preferred embodiment, a dental apparatus is provided having a neck portion interconnecting an elongated handle portion and a head portion, with the head portion being angled upwardly of the handle portion. Preferably, this angle should be about 15 to 30 degrees.

A plurality of tufts of bristles is fixedly attached to the face of said head portion, said tufts of bristles having wedge means and conforming means to enable penetration into and cleaning of said interstices, surfaces and interfaces. In particular, a single row of preferably five tufts of bristles is disposed substantially perpendicularly of said handle portion and at the end of said head portion, with the free end of each of said plurality of tufts being beveled. Said bevel of the plurality of bristles slopes downwards from a vertex formed at said free end of the longest bristle in each of said tufts. In the preferred embodiment, this bevel should be about 40 to 50 degrees with respect to the horizontal plane of the dental apparatus.

The tufts of bristles also have a plurality of bristles of varying lengths such that a concave surface generally corresponding to the convex configuration of the surfaces of the teeth is formed by the said free ends thereof. Preferably, the bristles should vary in length from about 5 to 8 millimeters. More particularly, the longer bristles should preferably be about 7 millimeters long and the shorter bristles should be about 6 millimeters long. In the preferred embodiment, the longer bristles are relatively firm and the shorter bristles are relatively soft. Preferably, each of the plurality of bristle tufts should be 1.5 to 2.0 millimeters wide and be separated by 0.5 to 1.0 millimeters.

Accordingly, it is a feature of the present invention that the shape and configuration of the tufts of bristles overcomes the limitations and disadvantages of the prior art.

Accordingly, it is an object of the present invention to provide an apparatus and method for penetrating the interstices and interproximal surfaces between the teeth, the surfaces at and below the gum margins, and the tooth-gum interfaces including the grooves and crevices thereof.

It is also an object and feature of the present invention to provide an apparatus for effectively and conveniently cleaning the interstices and interproximal surfaces between the teeth, the surfaces at and below the gum margins, and the tooth-gum interfaces including the grooves and crevices thereof.

It is an object and feature of the present invention to provide an apparatus and method for improving the daily regimen of dental hygiene whereby hard-to-reach surfaces and interfaces may be routinely cleaned with less expenditure of time than required by flossing.

It is a further object of the present invention to provide a method to clean the hard-to-reach surfaces and interfaces in the mouth cavity without the inconvenience and discomfort of using dental floss.

It is still a further object of the present invention to provide an effective dental apparatus which is similar to the familiar conventional toothbrush whereby acceptance and incorporation of said apparatus into a daily regimen of dental hygiene will be likely.

It is also an object of the present invention to provide an effective and convenient dental apparatus for cleaning the surfaces and interfaces proximal to crowns disposed in the mouth cavity.

It is a specific object of the present invention to provide a dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, said head portion angled upwards from said neck portion forming an acute angle therewith, a single row of a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping upwards from a vertex formed at said free end of the outermost bristle in each of said tufts, said tufts of bristles further having a plurality of bristles of varying lengths including a series of bristles in which the longer of said bristles disposed on opposite sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, and said longer bristles having the firmness substantially the same as the bristles of conventional hard-bristled toothbrushes, and said shorter bristles having the firmness substantially the same as the bristles of conventional medium-bristled toothbrushes.

These and other objects and features of the present invention will become apparent from the following detailed description, wherein reference is made to the figures in the accompanying drawings.

IN THE DRAWINGS

FIG. 1 is a perspective view of a dental apparatus, disposed upon the interior surface of teeth, embodying the concept of the present invention.

FIG. 2 is a perspective view of a row of tufts of bristles contained on a dental apparatus embodying the concept of the present invention.

FIG. 3 is a perspective view of the head and neck portions of the dental apparatus depicted in FIGS. 1 and 2.

FIG. 4 is a bottom view of the head and neck portions of the dental apparatus depicted in FIG. 3.

FIG. 5 is a cross sectional view of the head and neck portions of the dental apparatus depicted in FIG. 3, along line 5—5.

FIG. 6 is an end elevation view of the head and neck portions of the dental apparatus depicted in FIG. 3, along line 6—6.

FIG. 7 is a perspective view of a dental apparatus, disposed upon the exterior surface of teeth, embodying the concept of the present invention.

FIG. 8 is a perspective view of the dental apparatus bristle tufts embodying the concept of the present invention, depicting penetrating the apical portion of the embrasure between adjacent teeth.

FIG. 9 is a perspective view of the dental apparatus bristle tufts embodying the concept of the present invention, depicting penetrating the medial portion of the embrasure between adjacent teeth.

FIG. 10 is a perspective view of the dental apparatus bristle tufts embodying the concept of the present invention, depicting brushing of the embrasure between adjacent and partially impacted teeth.

FIG. 11 is a perspective view of the dental apparatus bristle tufts embodying the concept of the present invention, depicting brushing of the gum margin of a lower tooth.

FIG. 12 is a perspective view of the dental apparatus bristle tufts embodying the concept of the present invention, depicting brushing of the gum margin of an upper tooth.

DETAILED DESCRIPTION

Referring now to FIG. 1, there may be seen a perspective view of dental apparatus 2, embodying the concept of the present invention, disposed in the interstice 42 between adjacent teeth 40 and 41. Dental apparatus 2 consists of handle portion 3, neck portion 5, and head portion 6. Head portion 6 contains tuft of bristles 19 preferably projecting substantially perpendicularly from face 8. Face 9, opposite and parallel to face 8, is shown angled upwardly of handle portion 3 at neck portion 5.

Still referring to FIG. 1, dental apparatus 2 is shown disposed in mouth cavity 30, containing front portion 34, rear portion 33, labial portion 31 and lingual portion 32. Thus, in FIG. 1, dental apparatus 2 is disposed upon the lingual surface 32 of mouth cavity 30. Similarly, in FIG. 7, dental apparatus 2 is disposed upon the labial surface 31 of mouth cavity 30. More particularly, dental apparatus 2 is disposed in the interstice 46 between adjacent teeth 45 and 47.

Referring now to FIG. 2, a perspective view of the configuration of the tufts of bristles upon the head portion 6 of the dental apparatus 2 is shown. To provide the optimum maneuverability of the brush to achieve intimate contact between the bristles and the various surfaces in the mouth cavity, the tufts 15–19 are disposed preferably substantially transversely of face 8 of head portion 6. It is clearly seen that tufts 15–19 are aligned parallel to edge 7 of head portion 6.

As has been hereinbefore described, this configuration of the tufts is contrary to the teachings of the prior art. Furthermore, as will be described in detail, the cooperation of the rigid tufts, their beveled edges and the disposition thereof, provide a unique advantage over the prior art which renders the preferred embodiment suitable for virtually any hard-to-reach surface or space in the mouth cavity.

Still referring to FIG. 2, the wedge-like configuration of each tuft 15–19 and concave surface 25, formed from end portions of tufts of bristles 15*a*–19*a*, is shown. More particularly, the bristles disposed at the proximal edge 7 of handle portion 6 consist of longer bristles, 15L–19L, while the bristles disposed at the opposite ends of tufts 15–19 consist of shorter bristles 15*s*–19*s*. As should be apparent, the bristles disposed between bristles 15L–15s, 16L–16s, 17L–17s, 18L–18s, and 19L–19s, respectively, are intermediate in length thereof. To achieve said wedge-like configuration, the bristle length is progressively and linearly decreased from said proximal edge 7 toward the opposite end of each said tuft 15–19.

As is also seen in FIG. 2, edges 15c–19c, comprised of longer bristles 15L–19L, are provided to guide the preferred embodiment into difficult-to-reach spaces and interfaces in the mouth cavity. Indeed, a dental apparatus made in accordance with the teachings of the present invention may be caused to enter regions of the mouth heretofore virtually unreachable with a toothbrush and the like. As will be described in detail, the concave configuration of surface 25 promotes contact between the teeth, tooth-gum interfaces and embrasures, gum surfaces, and bristles ends 15a–19a.

To achieve said concave configuration, the bristle length is progressively decreased from outer tufts 15 and 19 toward the middle tuft 17. Accordingly, the bristles comprising tuft 17 are shorter than the corresponding bristles comprising adjacent tufts 16 and 18. Similarly, the bristles comprising tuft 16 are shorter than the corresponding bristles comprising adjacent tuft 15, and the bristles comprising tuft 18 are shorter than the corresponding bristles comprising adjacent tuft 19.

FIG. 3 depicts head portion 6 with tuft of bristles 19, plurality of bristles 19a and bevel 19b therein. As hereinbefore described, plurality of bristles 19a is comprised of longer bristles 19L and shorter bristles 19s. It is a feature of the preferred embodiment that there should be twice as many shorter bristles as longer bristles. Ergo, bristles 19a preferably consist of one-third longer bristles and two-thirds shorter bristles.

In accordance with the concept of the present invention, plurality of bristles 19L should be 6 to 8 millimeters long, and preferably 7 millimeters long. Similarly, plurality of bristles 15L–18L (not shown) should also be 6 to 8 millimeters long, and preferably 7 millimeters long. It is a further feature of the present invention that the longer bristles 15L–19L should preferably be relatively firm. Thus, the firmness of bristles 15L–19L should preferably be comparable to the firmness of the bristles of a "hard" conventional toothbrush, thereby permitting the maximum penetration thereof into the interproximal surfaces and gum grooves and crevices.

It is also a feature of the present invention that plurality of bristles 19s should be 5 to 7 millimeters long, and preferably 6 millimeters long. Similarly, plurality of bristles 15s–18s (not shown) should also be 5 to 7 millimeters long, and preferably 6 millimeters long. It is a feature of the present invention that the shorter bristles 15s–19s should preferably be relatively soft. Accordingly, the firmness of bristles 15s–19s should preferably be comparable to the firmness of the bristles of a "medium" conventional toothbrush, thereby permitting these bristles to adapt to the contours of the proximal tooth and adjacent surfaces.

Still referring to FIG. 3, tuft bevel 19b, formed by said progression of bristles 19L and 19s, should preferably be angled forty five (45) degrees with respect to the horizontal. It is a feature of the present invention that beveled edge 19b and leading edge 19c of the tufts of bristles enable penetration into even the most constricted of interstices between the teeth and embrasures in the tooth-gum interface.

Now referring to FIG. 4, a bottom view of the configuration of the tufts of bristles upon the head portion 6 of the dental apparatus 2 is shown. To provide the optimum maneuverability of the brush to achieve intimate contact between the bristles and the various surfaces n the mouth cavity, the tufts 15–19 should preferably be disposed transversely of the head portion 6. As has been hereinbefore described, this configuration of the tufts is contrary to the teachings of the prior art. Furthermore, as will be described in detail, the cooperation of the rigid tufts, their beveled edges and said transverse disposition thereof, provide advantages over the prior art which renders the preferred embodiment suitable for penetrating and cleaning virtually any hard-to-reach surface or space in the mouth cavity.

Still referring to FIG. 4, tufts 15–19 are placed in close proximity to each other to maintain a continuous concave configuration which, at its highest point, is the leading edge capable of penetrating the said hard-to-reach surfaces and spaces targeted by the present invention. More particularly, tufts 15 and 16 are separated by space 21, tufts 16 and 17 are separated by space 22, tufts 17 and 18 are separated by space 23, and tufts 18 and 19 are separated by space 24. It is a feature of the present invention that each such tuft should be separated from an adjacent tuft by approximately 0.5 to 1.0 millimeters.

FIGS. 5 and 6 show cross-sectional and end views, respectively, of the dental apparatus' head portion 6 depicted in FIGS. 2 and 3. More particularly, FIG. 5 depicts the cross-sectional view of head portion 6 along line 5—5 in FIG. 3. In accordance with the concept of the present invention, dental apparatus 2 with body portion 10 preferably consists of five tufts of bristles 15–19. Concave bristle surface 25 is formed by the close proximity of wedges 15b–19b as hereinbefore described in detail.

Referring now to FIG. 6, an end view of the head portion depicted in FIGS. 2 and 3, leading edges 15c–19c of tufts 15–19, respectively, define concave surface 25. This concave surface configuration facilitates the penetration by the plurality of longer, stiff bristles into hard-to-reach and remote surfaces and spaces. It also enables the shorter, softer bristles to cooperate with the convex contours of tooth surfaces and embrasures, thereby effectuating intimate contact therewith and performing a sweeping and cleaning function thereon.

As hereinbefore stated, it is an object of the present invention to provide an apparatus which affords maximum penetration into interproximal surfaces and embrasures between the teeth and tooth-gum interface. It is accordingly an important feature of the present invention that each of the tufts of bristles is structured with a beveled edge to promote penetration into these said hard-to-reach areas, regardless of their placement in the mouth cavity and the associated clearances thereof.

FIGS. 8–12 illustrate the features of the present invention which accomplish the objectives described herein. In FIG. 8, there may be seen a perspective view of the penetration of the preferred embodiment into the apical portion of embrasure 53 between molar tooth 50 and adjacent molar tooth 55, located directly behind and obscured by tooth 50. Also shown is gum margin 51 and associated ridge 52a–b. Concave surface 25 of dental apparatus end portion 7 enters embrasure 53 in a top-down direction and establishes contact with the convex surfaces of teeth 50 and 55. Plurality of stiff bristles 15L–19L (not shown), in cooperation with bevels 15b–19b (not shown), facilitate access to and penetration into embrasure 53. Plurality of softer bristles 15s–19s (not shown) facilitate the cooperation and intimiate contact between concave contour 25 of tufts 15–19 and the contours of the tooth surfaces and interfaces. As the preferred embodiment downwardly traverses embrasure 53, particles, and the like, at and below the gum margin 51, are forcibly purged. Similarly, the action of the shorter bristles tends to sweep away foreign matter from gum ridge 52a–b.

FIG. 9 depicts a perspective view of the penetration of the preferred embodiment into the medial portion of embrasure 53 between tooth 50 and tooth 55 (not shown because it is obscurred by tooth 50). Concave surface 25 of dental apparatus end portion 7 enters embrasure 53 from the side thereof and simultaneously establishes contact with the convex surfaces of teeth 50 and 55, and with gum margin 51 as well as gum ridge 52a–b. Moving and sweeping the preferred embodiment through embrasure 53 and tooth-gum interfaces 51 and 52a–b dislodges captured particles and plaque.

In FIG. 10 there may be seen a perspective view of the inhibited penetration of the preferred embodiment into the medial portion of embrasure 73, where molar 70 is impacted by molar 75 (not shown because it is obscurred by molar 70) at surface 74. As should be apparent, impacted teeth prevent the passage of even thin bristles through embrasures. Indeed, even dental floss may tear during attempted entry therein. Notwithstanding, the preferred embodiment may at least partially enter embrasure 73 and achieve a corresponding partial removal of foreign particles and the like. More particularly, as depicted in FIG. 10, tufts 16–18 adapt to the configuration of the impacting region 74, thereby accomplishing its cleaning function of embrasure 73 even under these adverse conditions. Additionally, tuft 19 may nonetheless enter gum margin 71 and ridge 72a–b, again, accomplishing its normal cleaning function.

Now referring to FIGS. 11 and 12, thee may be seen perspective views of the penetration of the preferred embodiment into the gum margins of incisors in the lower and upper rows of teeth, respectively. FIG. 11 depicts incisor tooth 60 disposed in lower row of teeth and corresponding incisor tooth 63 disposed in the upper row. Tooth 60 is surrounded by gum margin 61 and associated ridge 62a–b. Leading edge 19c and bevel 19b of tuft 19 easily enter said tooth-gum interfaces 61 and 62a–b, and expel foreign matter therefrom. Bristles 19L provide the penetrating power and bristles 19s provide the adaptability to accomplish these difficult functions which have heretofore been unavailable to the public in a convenient and reliable embodiment.

Similarly, in FIG. 12, leading edge 15c and bevel 15b of tuft 15 easily enter tooth-gum interfaces 64 and 65a–b of upper incisor 63, and expel foreign matter therefrom. As has been hereinbefore described, bristles 15L provide the penetrating power and bristles 15s provide the adaptability to the neighboring contours to accomplishing the requisite cleaning functions.

It should be apparent to those skilled in the art that the present invention enables convenient and reliable penetration and cleaning of difficult-to-reach embrasures between the teeth, particularly where there is impacting between adjacent teeth, the gum margin in the rear and lingual portion of the mouth cavity, and the grooves and crevices of the gums. Additionally, the angle between the head and neck portions of the preferred embodiment may be varied to enhance reachability into the remote portions of the mouth cavity.

More particularly and referring to FIG. 3, face 8 of head portion 6 of the preferred embodiment should preferably be angled upwards approximately 15 to 30 degrees with respect to handle portion 3, neck portion 5 being the vertex thereof. Now referring to FIG. 1, it should be apparent that this upward disposition of the head portion is particularly advantageous because it affords maximum reachability of dental apparatus 2 especially into the lingual side 32 of rear portion 33 of mouth cavity 30.

This angularity feature of the present invention affords easy placement of plurality of bristle tufts 15–19 upon labial portion 31 and lingual portion 32 of mouth cavity 30, and thereby provides convenience and reliability heretofore unknown in the prior art. Nevertheless, the penetration and cleaning features and functions of the present invention may also be substantially accomplished in embodiments with head portion 6 being angled downwardly of handle portion 3, and even with head portion 6 and handle portion 5 being collinear. Such alternative handle configurations simply require adjustments in the manner and orientation in which a dental apparatus within the concept of the present invention is held in the hands of the user thereof. But while access to the surfaces and embrasures in the front portion 34 of labial surface 31 of mouth cavity 30 have been found to be convenient regardless of the angularity of the embodiment of the present invention, it should be clear from the foregoing description that the preferred embodiment provides the optimum access to the difficult-to-reach lingual surface 32 of rear portion 33 of mouth cavity 30.

It should be clear to those knowledgeable in the art that the present invention is particularly advantageous for cleaning the surfaces and interfaces proximal to a dental crown and the like. Only limited access to a dental crown is possible because it is fixedly and posteriorly attached to an adjacent natural tooth. Such attachment is usually achieved by dentists using a bridge-like appliance which is cemented to the crown and natural tooth. Accordingly, floss cannot be properly disposed between the crown and adjoining natural tooth. A dental apparatus under the concept of the present invention, however, may reach these surfaces and penetrate their concomitant interfaces and embrasures, either from the front or the apex portion thereof. Thus, utilizing the advantageous structures and features of the present invention provides a preferable program of dental hygiene whereby even the heretofore infrequently cleaned surfaces, interfaces, and embrasures associated with dental crowns and the like are maintained.

It should also be apparent to those skilled in the art that the present invention enables not only improved penetration into the interstices and embrasures of the mouth cavity, but also improved maneuverability of the bristle tufts whereby intimate contact with the various surfaces therein is obtained. Referring to FIG. 4, it should be clear that the disposition of tufts 15–19 may deviate from being substantially parallel to edge 7 of head portion 6 and nevertheless achieve sufficient penetration of these interstices and embrasures, and contact with their associated surfaces.

Other variations and modifications will, of course, become apparent from a consideration of the structures and techniques hereinbefore described and depicted.

Accordingly, it should be clearly understood that the present invention is not intended to be limited by the particular features and structures hereinbefore described and depicted in the accompanying drawings, but that the concept of the present invention is to be measured by the scope of the appended claims herein.

What is claimed is:

1. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, a plurality of tufts of bristles fixedly attached to the face of said head portion and disposed substantially perpendicularly thereof, said plurality of tufts of bristles having wedge means, to enable penetration into said interstices, surfaces and interfaces, including the beveled free end of each of said plurality of tufts of bristles which are disposed at the longitudinal edge of said end of said head portion, said bevel sloping downwards from a vertex formed at said free end of the longest bristle in each of said tufts, and forming a substantially planar surface disposed about 40 to 50 degrees with respect to the horizontal plane of said head portion, said plurality of tufts of bristles further having conforming means, to enable cleaning of said interstices, surfaces and interfaces, including said plurality of tufts of bristles having a plurality of bristles of varying lengths comprising a series of bristles in which the longer of said bristles disposed proximal to the sides of said face of said head portion being a first length, the shorter of said bristles disposed proximal to the longitudinal center of said face of said head portion being a second length, said second length being shorter than said first length, and the intervening bristles between said longer bristles and said shorter bristles being of corresponding varying length between said first length and said second length such that a concave surface to intimately contact the corresponding convex configuration of the surfaces of said teeth, and said tooth-gum interfaces and gum margins is formed by said free ends thereof.

2. The apparatus described in claim 1 with said longer bristles having the firmness substantially the same as the bristles of conventional hard-bristled toothbrushes, to enable maximum penetration into said interstices, surfaces and interfaces.

3. The apparatus described in claim 2 with said shorter bristles having the firmness substantially the same as the bristles of conventional medium-bristled toothbrushes to enable both penetration and conformance to the contours of said interstices, surfaces and interfaces.

4. The apparatus described in claim 3 wherein said longer bristles are about 6 to 8 millimeters long.

5. The apparatus described in claim 4 wherein said longer bristles are about 7 millimeters long.

6. The apparatus described in claim 4 wherein said shorter bristles are about 5 to 7 millimeters long.

7. The apparatus described in claim 6 wherein said shorter bristles are about 6 millimeters long.

8. The apparatus described in claim 7 wherein each of said plurality of tufts of bristles is about 1.5 to 2.0 millimeters wide.

9. The apparatus described in claim 8 wherein each of said plurality of tufts of bristles is about 2 millimeters wide.

10. The apparatus described in claim 8 wherein said plurality of tufts of bristles is disposed on said face of said head portion with each said tuft being separated from an adjacent tuft by about 0.5 to 1.0 millimeters.

11. The apparatus described in claim 10 wherein said plurality of tufts of bristles is disposed on said face of said head portion with each said tuft being separated from an adjacent tuft by about 1 millimeter.

12. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping downwards from a vertex formed at said free end of the longest bristles in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

13. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, said head portion angled upwards from said neck portion forming an acute angle therewith, a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping downwards from a vertex formed at said free end of the longest bristles in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

14. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, said head portion angled downwards from said neck portion forming an acute angle therewith, a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping downwards from a vertex formed at said free end of the longest bristle in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

15. A dental apparatus adapted for penetrating and cleaning the interstices and interproximal surfaces between the teeth, the surfaces at and below the gum margins, and the tooth-gum interfaces including the grooves and crevices thereof comprising an elongated handle portion, a head portion, a neck portion interconnecting said handle portion and said head portion, a single row of a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping downwards from a vertex formed at said free end of the longest bristles in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

16. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion, a head portion, a neck portion interconnecting said handle portion and said head portion, said head portion angled upwards from said neck portion forming an acute angle therewith, a single row of a plurality of tufts of bristles fixedly attached to the face of said head portion and disposed substantially perpendicularly thereof, said tufts of bristles having the free end of each of said plurality of tufts of bristles which are disposed at said end said head portion beveled, said bevel sloping downwards from a vertex formed at said free end of the longest bristles in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

17. A dental apparatus adapted for penetrating and cleaning the interstices and interproximal surfaces between the teeth, the surfaces at and below the gum margins, and the tooth-gum interfaces including the grooves and crevices thereof, comprising an elongated handle portion a head portion, a neck portion interconnecting said handle portion and said head portion, said head portion angled downwards from said neck portion forming an acute angle therewith, a single row of a plurality of tufts of bristles fixedly attached to the face of said head portion and disposed substantially perpendicularly thereof, said tufts of bristles having the free end of each of said plurality of tufts of bristles which are disposed at said end of said head portion beveled, said bevel sloping downwards from a vertex formed at said free end of the longest bristles in each of said tufts, said tufts of bristles further having a plurality of bristles of varying lengths including a series of bristles in which the longer of said bristles disposed proximal to the sides of said face of said head portion being a first length, the shorter of said bristles disposed proximal to the longitudinal center of said face of said head portion being a second length, with said second length being shorter than said first length, the intervening bristles between said longer bristles and said shorter bristles being of corresponding varying length between said first length and said second length such that a concave surface generally corresponding to the convex configuration of the surfaces of the teeth is formed by the said free ends thereof, said longer bristles having the firmness substantially the same as the bristles of conventional hard-bristled toothbrushes, and said shorter bristles having the firmness substantially the same as the bristles of conventional medium-bristled toothbrushes.

* * * * *